US005297779A

United States Patent [19]

Collins, Jr. et al.

[11] Patent Number: 5,297,779

[45] Date of Patent: Mar. 29, 1994

[54] JACK MECHANISM HAVING SAFETY PROTECTION FOR WORKERS

[75] Inventors: Robert H. Collins, Jr., Incline, Nev.; Wilbert Jollivette, Houston, Tex.

[73] Assignee: Sumner Manufacturing, Co., Inc., Houston, Tex.

[21] Appl. No.: 3,793

[22] Filed: Jan. 13, 1993

[51] Int. Cl.[5] ..... B66F 3/08

[52] U.S. Cl. ..... 254/98

[58] Field of Search ..... 248/410, 351, 352, 354.1, 248/354.3, 454.4, 354.6; 254/98-103, 418, 420, 424, 106; 269/166, 167

[56] References Cited

U.S. PATENT DOCUMENTS

| | | | |
|---|---|---|---|
| 3,313,505 | 4/1967 | Petrie | 254/98 |
| 3,588,023 | 6/1971 | Cohen | 248/410 |
| 4,221,363 | 9/1980 | Jasper | 254/98 |

FOREIGN PATENT DOCUMENTS

| | | | |
|---|---|---|---|
| 1230843 | 5/1971 | United Kingdom | 248/410 |

*Primary Examiner*—Robert C. Watson
*Attorney, Agent, or Firm*—James L. Jackson

[57] ABSTRACT

A high/low screw jack stand mechanism is presented having inner and outer telescoping tubes for coarse elevational adjustment and having an adjustment screw and nut assembly for fine elevational adjustment. For coarse adjustment a thrust washer, surrounding the inner work elevation tube, permits free upward movement of the elevating tube relative to the outer support tube and is automatically positioned in angular binding relation with the elevating tube by a thrust washer positioner which has supporting engagement with one side of the thrust washer to restrain downward movement of the elevating tube. A thrust washer restraint member extends upwardly from and in spaced relation with the thrust washer positioner to restrain the thrust washer from moving upwardly along with the elevation tube. To ensure against possible injury to workers when the thrust washer is manually moved to its release position, an inner stop is provided within the support tube to limit downward movement of the elevating tube to a position at which the adjustment nut and elevation tube support flange is sufficiently spaced from the thrust washer and its restraint that injury cannot occur.

17 Claims, 2 Drawing Sheets

JACK MECHANISM HAVING SAFETY PROTECTION FOR WORKERS

FIELD OF THE INVENTION

This invention relates generally to manually operated mechanical jack stand mechanisms, also referred to as screw jacks or pipe jacks, for supporting and positioning pipe, shapes or rounds for fabricating or welding operations. More particularly, the present invention concerns a manually operated mechanical jack stand mechanism that is provided with safety features to prevent or minimize the possibility of injury to workers as the jack stand mechanism is utilized.

BACKGROUND OF THE INVENTION

Small portable, generally triangular screw jack stands have been employed for many years for the temporary support of mechanical objects during construction or other working operations. Screw jack stands are especially useful in the support and alignment of pipe such as for positioning adjacent pipe sections and pipe fittings in precise alignment for welding operations. They of course find many other uses as well. For the support of pipe, screw thread type pipe jacks are typically provided with various types of support heads depending upon the construction operation that is to be accomplished. For example, one type of support head may take the form of a V-shaped cradle that receives and centers the pipe to be supported. This type of object support is known in the industry as a "V-head". Where the pipe is to be supported for rotation, pipe support heads having horizontally arranged, spaced rollers may be employed. This type of object support is referred to as a "roller head".

One particular type of screw jack stand is known as the "High/Low Screw Jack" stand which incorporates a generally triangular base incorporating a vertically oriented support tube. An elevation tube is received in linearly movable telescoping relation within the support tube and may be manually raised or lowered to position the object supported thereby near its desired position. This adjustment may be referred to as a "coarse adjustment". Thereafter, the jack screw, which is located in rotatable but telescoping relation within the elevation tube, is manipulated upwardly or downwardly typically by manually rotating an adjustment nut to achieve precise positioning of the support head and its load. This character of adjustment may be referred to as a "fine adjustment".

To permit the coarse adjustment that is mentioned above, these high/low screw jack stand mechanisms are typically provided with a thrust washer locking mechanism incorporating a thrust washer positioner which is fixed to the vertically oriented support tube or outer tube of the base structure and which defines an upper tapered extremity which is located above the upper end of the elevation tube. A thrust washer is then positioned about the inner tubular member or elevation tube and, when the thrust washer is positioned in normal relation to the elevation tube, it will allow vertical movement of the elevation tube within the central opening of the thrust washer. The thrust washer is disposed for contact with the thrust washer positioner at one side thereof so that only one side is restrained. This allows the thrust washer to become positioned by gravity at an angulated relation with respect to the elevation tube which causes binding of the thrust washer relative to the elevation tube. When the thrust washer becomes so bound, with a downwardly directed force acting upon the elevation tube, the elevation tube will be restrained or locked against further downward movement relative to the thrust washer. This is the coarse upward adjustment that is mentioned above. To accomplish coarse adjustment of the screw jack stand, the elevation tube, in absence of any load thereof, is moved upwardly. This upward movement also imparts upward movement to the angulated and bound thrust washer. When a bound thrust washer is moved upwardly it will typically shift by gravity from its angulated and bound position relative to the elevating tube. When the thrust washer has shifted sufficiently that it assumes a substantially normal relation with the elevation tube, it will slide downwardly by gravity relative to the elevation tube so that it is supported only by its engagement with the thrust washer positioner. As soon as the elevation tube has been raised to its desired height and the manual force moving it upwardly has been released, it will be forced downwardly by gravity and by any load that is supported thereby, thus causing the thrust washer to again assume the angulated locking or restraining position which is mentioned above. Coarse upward adjustment of the elevation tube is therefore is achieved simply by applying an upward force to the elevation tube sufficient to move it to the desired height. When the desired height of the elevation tube has been achieved and the lifting force has been removed, the thrust washer will automatically lock the elevation tube against downward movement.

In the event the elevation tube is higher than desired, the locking or restraining action of the thrust washer can be released by slight upward movement of the elevation tube and by manually moving the thrust washer to a substantially normal position in relation with the thrust tube. With the restraining action of the thrust washer relieved in this manner, the elevation tube can be manually restrained somewhat and lowered to the desired position after which the thrust washer may be released to again lock the elevation tube in immovable supported relation with the support tube.

The elevation tube of high/low screw jack mechanisms of this nature can fall if the thrust washer restraint device is inadvertently moved to its release position. Even without a load on the jack stand movement of the thrust washer to its release position can permit the elevation tube to suddenly descend toward its lowermost position. In the event this should occur, an injury to a worker could possibly can occur as the adjustment nut contacts the upper end of the support tube of the jack base. Though such an injury is considered quite rare, it nevertheless represents a problem which the present invention is specifically designed to overcome. It is desirable, therefore, to provide means for insuring against potential injury to workers or potential damage to supported objects in the event the thrust washer is moved inadvertently or otherwise to its release position, thereby allowing the elevation tube to descend toward its lowermost position.

Another potential problem with conventional high/-low screw jack stand mechanisms is the fact that the thrust washer can become mechanically bound to the elevation tube with sufficient binding force that it does not readily release. When the elevation tube is raised for coarse elevation of the work the thrust washer is sometimes sufficiently bound to the elevation tube such that it travels upwardly with it rather than remaining stationary. When this occurs, and the raising force is released, the elevation tube will descend to the restraint position that was originally established by the thrust washer. Since coarse positioning of the work is ordinarily accomplished without the worker being particularly observant of the position of the thrust washer relative to the elevation tube, it is desirable that high/low screw jack stand mechanisms of this nature be provided with means for insuring that the thrust washer remains stationary as the elevation tube is raised. BY maintaining the thrust washer at its desired lowermost position relative to the support tube the elevation tube can thus be manually raised to its desired position and released for thrust washer locking restraint at the desired elevated position. It is also desirable to provide a thrust washer structure which is so designed that it does not ordinarily become bound to the elevation tube and thus is easily released from its restraining position as the elevation tube is moved upwardly during coarse adjustment of the jack stand mechanism and the work supported thereby. Thus it is desirable that the thrust washer automatically release from its binding position when the elevation tube is raised and that it establish binding or locking with the elevation tube when the lifting force is removed.

These types of high/low screw jack stand mechanisms are often utilized for the purpose of supporting pipes during fabrication thereof by welding operations. For pipe support and alignment, during coarse elevation adjustment, the elevation tube is raised beneath the work until a V-shaped work cradle, roller head, or any other type of support at the upper end of the adjustment screw is moved into contact with the work. Alternatively, the elevation tube with the work piece thereon can be raised together for coarse positioning of the work. After this has been done, upward force on the elevation tube is released, thus allowing it to settle slightly to a position angulating the thrust washer and permitting binding restraint of the elevation tube substantially at the position of coarse adjustment. Since during upward movement of the elevation tube the thrust washer is typically inclined almost to its binding position, the settling that typically occurs during binding of the thrust washer is almost imperceptible. Thereafter, the jack screw may be raised by manual rotation of the adjustment nut, thereby moving the work upwardly to its desired position. The adjustment nut may also be manually operated for lowering the jack screw and its supported work to a position that is desired.

SUMMARY OF THE INVENTION

It is a principal feature of the present invention to provide a novel high/low screw jack stand mechanism incorporating coarse and fine adjustment features and which is also designed to prevent inadvertent injury to a worker or damage to a supported load in the event the elevation tube thrust washer restraint is inadvertently or suddenly released.

It is also a feature of the present invention to provide a high/low type screw jack stand mechanism having an internal stop within the lower portion of the support tube thereof to limit downward movement of the telescoping elevation tube of the jack mechanism so that portions of the upper structure of the jack mechanism can not pinch the hands or fingers of a worker if the elevation tube is released and permitted to fall.

It is also a feature of the present invention to provide a novel high/low type screw jack stand mechanism incorporating a thrust washer for restraining downward telescoping movement of the elevation tube relative to a support tube, which thrust washer is designed to resist binding with the elevation tube when tube restraining forces are not present.

It is an even further feature of the present invention to provide a novel high/low screw jack stand mechanism which incorporates a thrust washer restraint which minimizes upward movement of the thrust washer and induces the thrust washer to release any binding engagement thereof with the elevation tube when the elevation tube is being moved upwardly for coarse adjustment of the jack mechanism.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is an elevational view of a high/low screw jack mechanism which is constructed in accordance with the present invention and which is illustrated with the elevation tube thereof at its lowermost position relative to the support tube.

FIG. 2 is a sectional view of the high/low screw jack mechanism of FIG. 1 taken in plan along lines 2—2 of FIG. 1 and showing the telescoping support and elevation tubes thereof in section.

FIG. 3 is a vertical sectional view of a major portion of the high/low screw jack mechanism of FIGS. 1 and 2 and illustrating the elevation tube thereof at its lowermost position.

FIG. 4 is a partial sectional view similar to that of FIG. 3 and showing the elevation tube at an elevated position and showing the thrust washer of the jack stand in its released position relative to the support and elevation tubes thereof.

FIG. 5 is a fragmentary sectional view of the thrust washer of FIGS. 1–4, illustrating the cross-sectional configuration thereof in detail.

FIG. 6 is a fragmentary sectional view of an alternative embodiment showing an alternative thrust washer design.

DETAILED DESCRIPTION OF PREFERRED EMBODIMENT

Figure 1:
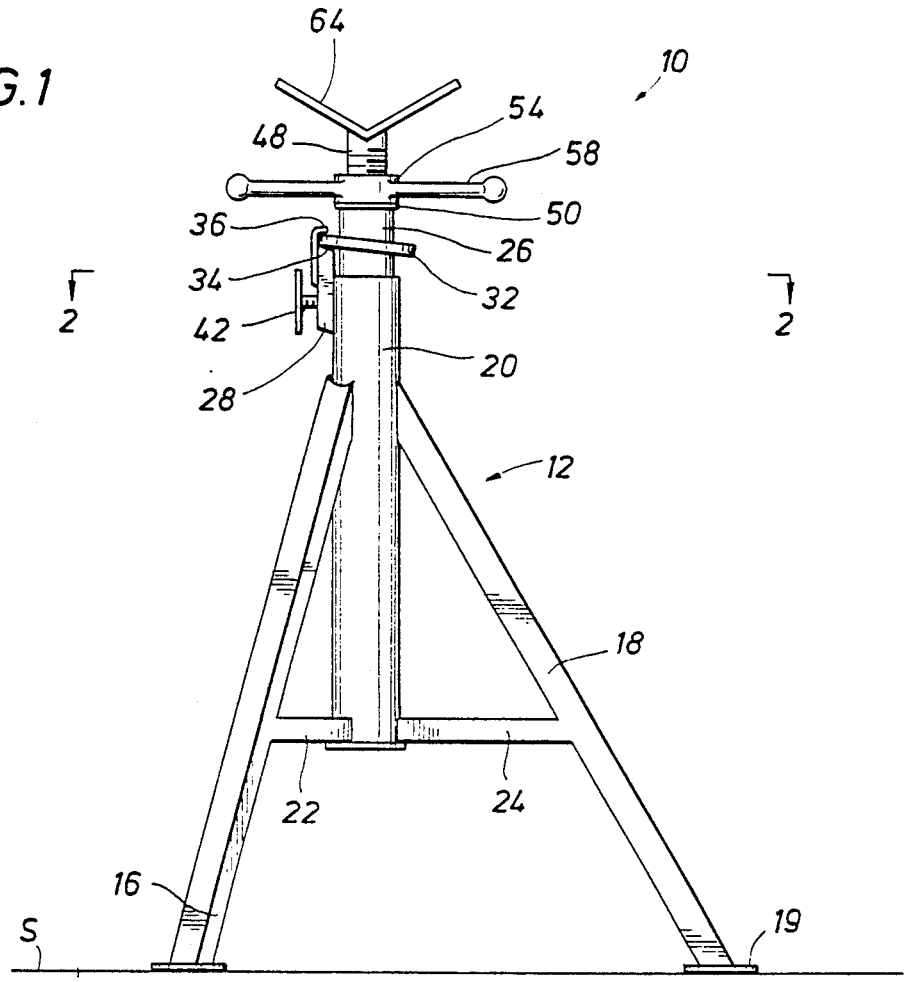
Figure 2:
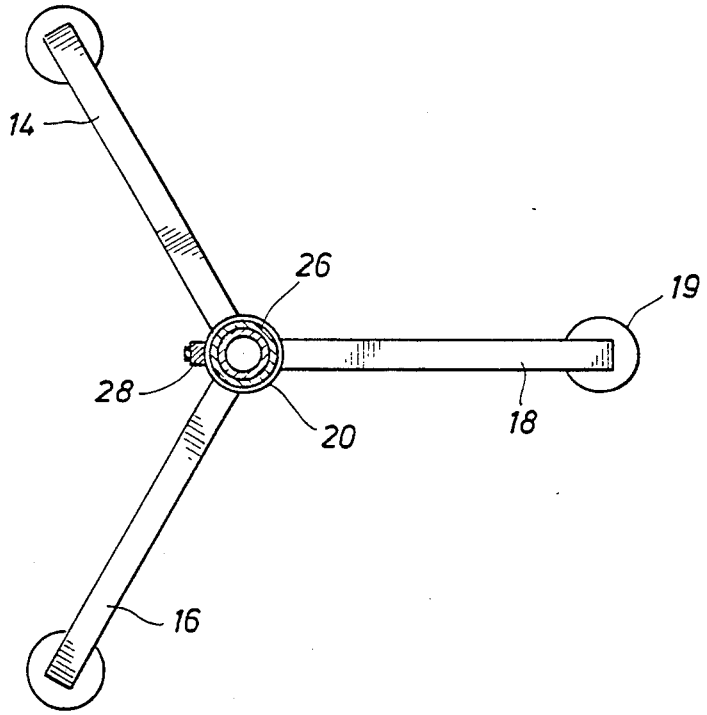

Referring now to the drawings and first to FIGS. 1 and 2, a high/low screw jack stand mechanism constructed in accordance with the present invention is illustrated generally at 10 and incorporates a base structure shown generally at 12 which incorporates a plurality, preferably three support legs 14, 16 and 18 which are angulated both vertically and horizontally. The upper extremities of the legs 14, 16 and 18 are welded or otherwise fixed to the upper portion of an elongate, vertically oriented support tube 20 which is shown to be of cylindrical cross-sectional configuration but which may conveniently take any other suitable tubular form without departing from the spirit and scope of the present invention. The lower end of the support tube 20 is supported by means of a plurality of transverse braces such as shown at 22 and 24 having the inner ends thereof welded or otherwise fixed to the support tube while the outer ends thereof are welded or otherwise structurally interconnected with the respective leg structures of the jack base.

For high/low adjustment of the jack stand mechanism, there is provided an elevation tube 26 which may also be of cylindrical configuration as shown and which is received telescopically within the outer support tube 20. The elevation tube 26 is intended to be linearly raised and lowered to desired positions by coarse and fine adjustment as indicated above and is intended to be locked or restrained in immovable, supporting relation relative to the support tube 20 at any desired elevated position relative thereto. For coarse, high/low adjustment a thrust washer positioner 28 is welded or otherwise fixed to the upper end portion of the support tube 20 with a portion thereof projecting upwardly above the upper end of the support tube. The thrust washer positioner is provided with a positioning extremity having a tapered upper surface 30 having its high point at its radial outward portion and angulating downwardly such that its low point is located adjacent the support tube.

For restraining downward movement of the elevation tube a thrust washer 32 is positioned in loose fitting relation about the elevation tube. When the trust washer is oriented in substantially normal relation with the elevation tube, the elevation tube and thrust washer are relatively movable such that the elevation tube may be raised or lowered to any desired position relative to the thrust washer and relative to the support tube. When the thrust washer is located at a predetermined inclined position relative to the elevation tube a binding action is established between the thrust washer and the elevation tube that restrains movement of the elevation tube relative to the thrust washer. The thrust washer is of a radial dimension that permits its radially outer portion to engage the upwardly directed angulated support surface 30 of the thrust washer positioner 28 thus restraining an outer portion of the thrust washer against further downward movement. Since an outer portion of the thrust washer is supported by the positioner 28, the opposite side of the thrust washer can move downwardly along with the elevation tube. This downward movement, however, is only slight and can be virtually imperceptible until a sufficient binding effect takes place that permits the thrust washer to restrain the elevation tube against further downward movement. This restraining or looking position is illustrated in detail in FIG. 3 of the drawings. The release position of the thrust washer is shown in detail in FIG. 4.

Figure 4:
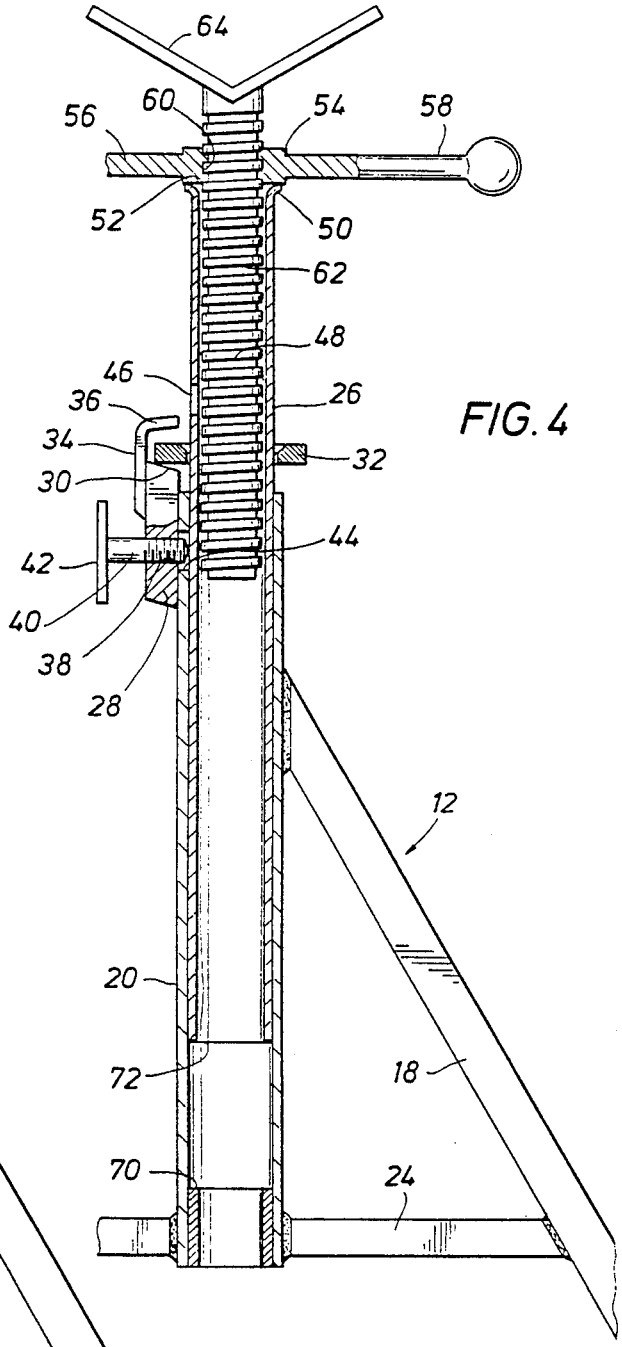
Figure 4:
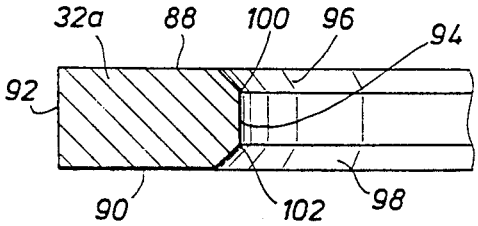

As mentioned above, it is desirable to insure release of the thrust washer from its binding and restraining relationship with the elevational tube 26 when upward adjusting movement of the elevation tube is desired. To provide this feature, a thrust washer restraint element is provided as shown at 34, which restraint element is secured to the thrust washer positioner 28 such as by welding or by any other suitable means of attachment. The thrust washer restraint element 34 is an elongate member preferably formed of a material such as steel, having an upper end portion 36 thereof which is bent radially inwardly so as to project toward the elevation tube 26 and to overly the tapered upper surface 30 of the thrust washer positioner. The inwardly projecting portion 36 of the thrust washer restraint element 34 cooperates with the thrust washer positioner to define a space between which an outer peripheral portion of the thrust washer 32 is located. Should the thrust washer 32 be moved upwardly along with the elevation tube 26, it can move only slightly until the outer peripheral portion thereof comes into contact with the inwardly projecting portion 36 of the restraint element 34. This will dislodge the thrust washer from the elevation tube by orienting it toward a more normal relation with the thrust tube as shown in FIG. 4. When so dislodged the thrust washer will fall and will be supported at one side by the positioner 28.

It may become desirable to secure the elevation tube 26 in fixed relation with the support tube 20 or to secure both the elevation tube and the jack screw in assembly with the support tube so as to prevent separation thereof. To provide for this feature, the thrust washer positioner 28 defines an internally threaded opening 38 which receives the externally threaded section 40 of a locking member 42. The support tube 20 is provided with an opening 44 which receives the threaded portion of the locking element therethrough, thus permitting the looking element to be tightened to secure the elevation tube 26 in substantially immovable assembly with the support tube. Likewise, the elevation tube 26 is provided with an opening 46 which becomes aligned with the opening 44 of the support tube when the elevation tube has been lowered to its maximum downward position relative to the support tube. When opening 46 is aligned with opening 44, the lock screw 42 may be threaded sufficiently to cause the lock screw to engage and lock a threaded elongate adjustment screw 48 which is received within the internal opening of the elevation tube 26. When the jack stand mechanism is not in use, the elevation tube may be collapsed to its full extent and both the elevation tube and the adjustment screw may be secured in assembly so that they can not become inadvertently separated such as during handling, storage, transportation, etc.

At its upper end, the elevation tube 26 defines a radially extending support flange 50 which provides an upwardly facing, substantially flat, circular support surface for engagement by the lower load transmitting portion 52 of an adjustment nut 54. The adjustment nut is provided with opposed adjusting handles 56 and 58 which preferably have knobs at the extremities thereof for ease of manual manipulation. The adjustment nut 54 defines internal threads 60 which are received by external threads 62 of the adjustment screw 48. Preferably, the threads 62 are coarse, acme threads but they may also take any other suitable form. At the upper end of the adjustment screw 48 is provided a V-shaped cradle or support 64 for effective support of a cylindrical object such as pipe to be welded. Alternatively, the support 64 may take any other suitable form without departing from the spirit or scope of this invention.

Figure 6:
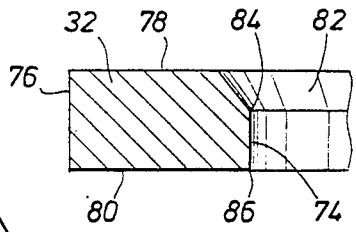

To provide protection against the possibility of injury, an internal stop member 66 is secured within the lower portion of the support tube 20 such as by welds 68 or by any other suitable means of attachment. As shown, the stop element 66 is of tubular construction and thus defines an upwardly facing circular stop surface 70 which is disposed for engagement by the lower extremity 72 of the elevation tube 26. Thus, in the event the thrust washer 32 is inadvertently shifted to the release position shown in FIG. 4 the elevation tube 26, together with the adjustment screw adjustment nut and any load supported by the cradle 64 might suddenly fall. If the elevation tube suddenly descends in this manner it will fall only so far as to bring the lower end 72 thereof into stopped engagement with the internal stop member 70. At this lowermost or stopped position as shown in FIG. 6, a significant space exists above the inwardly projecting portion 36 of the restraint member 34. Thus, in the event a worker's hands or fingers may be located immediately above the restraint projection 36, or above the thrust washer 32, the worker's hands or fingers can not become pinched or otherwise injured.

Figure 3:
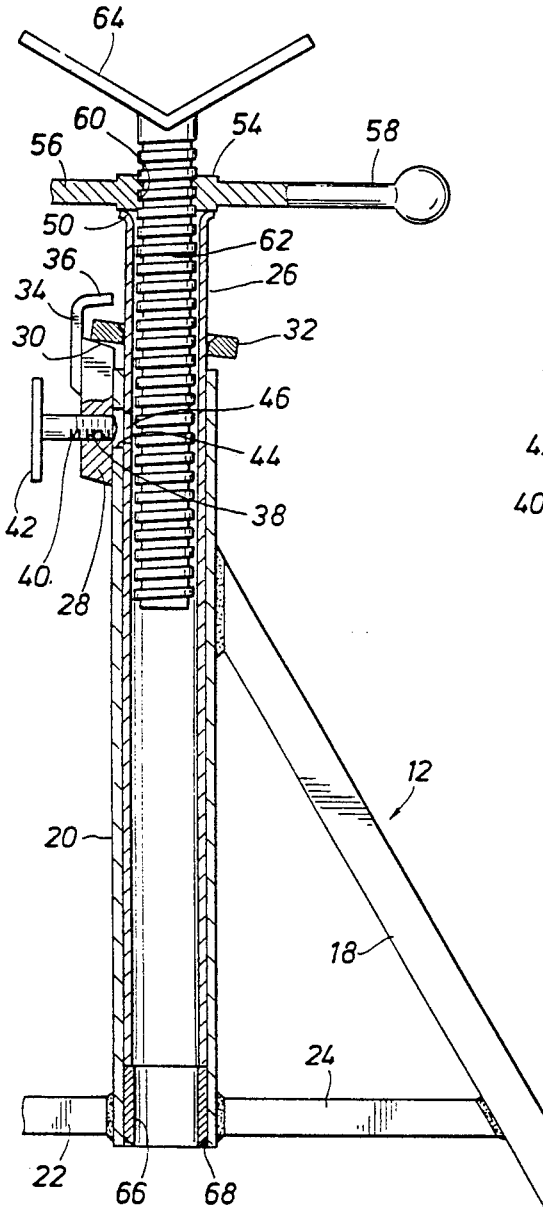
Figure 5:
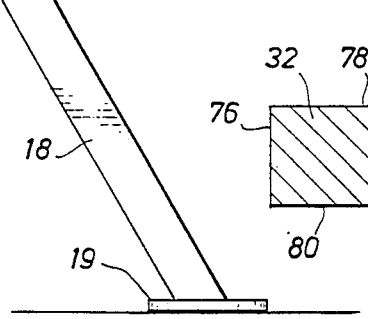

As mentioned above, it is desirable that the thrust washer be designed to efficiently release from its restraining or locking position as shown in FIG. 3, upon upward movement of the elevation tube. Accordingly, the thrust washer may conveniently take the form shown in the fragmentary sectional views of FIGS. 5 and 6. As shown in FIG. 5, the thrust washer 32 defines inner and outer cylindrical surfaces 74 and 76 which respectively define the inner and outer peripheries of the thrust washer. These inner and outer cylindrical surfaces are disposed in substantially normal relation with a pair of upper and lower, generally planar, circular surfaces 78 and 80. The inner peripheral portion of the thrust washer is also defined by a substantially conical surface 82 which intersects the cylindrical surface 74 and the upper planar surface 78 of the thrust washer. In the restraining position of the thrust washer as shown in FIG. 3, though the thrust washer is formed of relatively thick structural metal such as steel, the inner peripheral area for engagement with the elevation tube 26 is fairly small. Thus, binding between the elevation tube and the thrust washer is established between internal opposed corners 84 and 86 on opposite internal sides of the thrust washer opening. It has been determined that a thrust washer of this design will release quite readily from its locked, restraining engagement with the elevation tube.

An alternative thrust washer design is illustrated in FIG. 6 wherein the thrust washer **32*a* defines upper and lower planar circular surfaces 88 and 90 which intersect an outer cylindrical surface 92 in substantially normal relation. The thrust washer also defines an internal cylindrical surface segment 94 which is intersected by upper and lower substantially conical surfaces 96 and 98 respectively, and which cooperatively define the internal opening of the thrust washer 32*a*. The relationship of cylindrical surface segment 94 and the conical surfaces 96 and 98 define internal binding shoulders 100 and 102 which, on opposite sides of the elevation tube establish binding engagement to restrain and secure the elevation tube at any desired position relative to the support tube 20. It has been determined that the thrust washer designs of FIGS. 5 and 6 will each release quite readily from restraining engagement with the elevation tube. If any slight binding takes place, upward movement of the elevation tube will bring the thrust washer into engagement with the inwardly projecting portion 36 of the restraining element 34**, thereby dislodging the thrust washer from its binding position and thus allowing free upward movement of the elevation tube for coarse adjustment without any necessity to manipulate the thrust washers with the hands or fingers. This feature also helps to assist the workers in the prevention of any injury that might otherwise occur because it is not necessary to manually manipulate the thrust washer during raising of the elevation tube.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A safety jack stand mechanism for supporting and positioning pipes and other objects such as during construction operations, comprising:

(a) a base structure having a vertically oriented outer tubular member;

(b) an inner tubular member defining upper and lower ends being disposed in telescoping relation within said outer tubular member, said inner tubular member having a thrust surface at the upper end thereof;

(c)f an adjustment screw being received in telescoping relation within said inner tubular member and defining external threads, said adjustment screw having a support member at the upper extremity thereof for support of objects;

(d) an adjustment nut being threadedly received by said adjustment screw and being disposed in supported engagement with said thrust surface of said inner tubular member, said adjustment nut being rotatable relative to said adjustment screw and said inner tubular member for vertical adjustment of said inner tubular member and said support member;

(e) a thrust washer positioner being fixed to said outer tubular member and having an upper end portion thereof projecting above said outer tubular member;

(f) a thrust washer retainer element being fixed to said thrust washer positioner and having a portion thereof overlying and being disposed in spaced relation with said upper end portion of said thrust washer positioner;

(g) A thrust washer being located in loose fitting relation about said inner tubular member and, when disposed in predetermined angulated relation with said inner tubular member, establishing binding with said inner tubular member and restraining downward movement of said inner tubular member relative thereto, an outer peripheral portion of said thrust washer being located between said thrust washer positioner and said thrust washer retainer element and having positioned and supported engagement with said upper end portion of said thrust washer positioner; and means for limiting downwardly telescoping movement of said inner tubular member relative to said outer tubular member to the extent that, at the maximum downward position of said inner tubular member, said thrust surface of said inner tubular member and said adjustment screw have sufficient vertical clearance relative to said thrust washer and thrust washer retainer that the hand or fingers of a worker cannot become pinched therebetween.

2. The safety jack stand mechanism of claim 1, including:

a radially extending thrust support flange defining said thrust surface being provided at the upper end of said inner tubular member and having supporting engagement with said adjustment nut.

3. The safety jack stand mechanism of claim 1, wherein said means for limiting downwardly telescoping movement of said inner tubular member comprises:

a stop member being disposed within said outer tubular member and defining an upwardly facing stop shoulder being located for stopping engagement with said lower end of said inner tubular member.

4. The safety jack stand mechanism of claim 3, wherein said stop member comprises:

a tubular stop element being fixed within said outer tubular member and defining a circular upwardly facing generally planar stop surface defining said upwardly facing stop shoulder.

5. The safety jack stand mechanism of claim 3, wherein:

said stop member is fixed within said outer tubular member by welding.

6. The safety jack stand mechanism of claim 1, wherein said thrust washer retainer element comprises:

a elongate thrust washer retainer member projecting upwardly from said thrust washer positioner and having an upper portion thereof projecting radially inwardly toward said inner tubular member and overlying the upper end of said thrust washer positioner.

7. The safety jack stand mechanism of claim 6, wherein:

said elongate thrust washer retainer member is fixed to said thrust washer positioner by welding.

8. The safety jack stand mechanism of claim 1, wherein said thrust washer comprises:

a circular washer member having parallel upper and lower generally planar surfaces and having generally cylindrical inner and outer peripheral surfaces disposed in substantially normal relation with said upper and lower generally planar surfaces, said circular washer member further defining a generally conical upwardly facing intern-al surface intersecting said upper generally planar surface and said internal generally cylindrical surface.

9. The safety jack stand mechanism of claim 8, wherein:

said circular washer member further defines a generally conical downwardly facing inner peripheral surface intersecting said cylindrical inner surface and said lower generally planar surface.

10. A safety jack stand mechanism for supporting and positioning pipes and other objects such as during construction operations, comprising:

(a) a base structure having a vertically oriented outer tubular member;

(b) an inner tubular member defining upper and lower extremities and being disposed in telescoping relation within said outer tubular member and having a radially outwardly projecting peripheral thrust flange at the upper extremity thereof;

(c) an elongate adjustment screw being received in telescoping relation within said inner tubular member and defining external threads, said adjustment screw having a support member at the upper extremity thereof for support of objects;

(d) an adjustment nut being threadedly received by said adjustment screw and being supported by said outwardly projecting peripheral thrust flange, said adjustment nut being rotatable relative to said adjustment screw and said thrust flange for vertical adjustment of said adjustment screw and having opposed handles extending radially therefrom;

(e) a thrust washer positioner being fixed to said outer tubular member and having an upper end portion thereof projecting above said outer tubular member and defining a thrust washer positioning portion;

(f) a thrust washer retainer element being fixed to said thrust washer positioner and having a portion thereof overlying and being disposed in spaced relation with said washer positioning portion of said thrust washer positioner; and (g) a thrust washer being located in loose fitting relation about said inner tubular member and, when disposed in predetermined angulated relation with said inner tubular member, establishing binding with said inner tubular member and restraining down movement of said inner tubular member relative thereto, a peripheral portion of said thrust washer being located between said thrust washer positioner and said thrust washer retainer element and having positioned and supported engagement with said upper end portion of said thrust washer positioner; and (h) means for limiting downwardly telescoping movement of said inner tubular member relative to said outer tubular member to the extent that, at the maximum downward position of said inner tubular member, said thrust flange of said inner tubular member and said adjustment screw have sufficient vertical clearance relative to said thrust washer and thrust washer retainer that the hand or fingers of a worker cannot become pinched therebetween.

11. The jack stand mechanism of claim 10, wherein said means for limiting downwardly telescoping movement of said inner tubular member comprises:

a stop member being disposed within said outer tubular member and defining an upwardly facing stop shoulder being located for stopping engagement with said lower extremity of said inner tubular member.

12. The jack stand mechanism of claim 11, wherein said stop member comprises:

a tubular stop element being fixed within said outer tubular member and defining a circular upwardly facing generally planar stop surface defining said upwardly facing stop shoulder.

13. The jack stand mechanism of claim 11, wherein:

said stop member is fixed within said outer tubular member by welding.

14. The jack stand mechanism of claim 10, wherein said thrust washer retainer element comprises:

a elongate thrust washer retainer member projecting upwardly from said thrust washer positioner and having an upper portion thereof projecting radially inwardly toward said inner tubular member and overlying the upper end of said thrust washer positioner.

15. The jack stand mechanism of claim 14, wherein:

said elongate thrust washer retainer member is fixed to said thrust washer positioner by welding.

16. The jack stand mechanism of claim 10, wherein said thrust washer comprises:

a circular washer member having parallel upper and lower generally planar surfaces and having generally cylindrical inner and outer peripheral surfaces disposed in substantially normal relation with said upper and lower generally planar surfaces, said circular washer member further defining a generally conical upwardly facing internal surface intersecting said upper generally planar surface and said internal generally cylindrical surface.

17. The jack stand mechanism of claim 18, wherein:

said circular washer member further defines a generally conical downwardly facing inner peripheral surface intersecting said cylindrical inner surface and said lower generally planar surface.

* * * * *

US005297779B1

REEXAMINATION CERTIFICATE (3177th)

United States Patent [19] [11] B1 5,297,779

Collins, Jr. et al. [45] Certificate Issued Apr. 15, 1997

[54] JACK MECHANISM HAVING SAFETY PROTECTION FOR WORKERS

[75] Inventors: Robert H. Collins, Jr., Incline, Nev.; Wilbert Jollivette, Houston, Tex.

[73] Assignee: Sumner Manufacturing, Co., Inc., Houston, Tex.

Reexamination Request:
No. 90/004,265, Jun. 5, 1996

Reexamination Certificate for:

| | |
|---|---|
| Patent No.: | **5,297,779** |
| Issued: | **Mar. 29, 1994** |
| Appl. No.: | **3,793** |
| Filed: | **Jan. 13, 1993** |

[51] Int. Cl.[6] ..... B66F 3/08
[52] U.S. Cl. ..... 254/98
[58] Field of Search ..... 248/410, 351, 248/352, 354.1, 354.3, 454.4, 354.6; 254/98–103, 418, 420, 424, 106, 133 A; 269/166, 167

[56] References Cited

U.S. PATENT DOCUMENTS

| | | | |
|---|---|---|---|
| 1,024,860 | 4/1912 | Kline | 254/133 A |
| 1,579,002 | 3/1926 | Koch | 248/354.1 |
| 1,681,192 | 8/1928 | McBride | 248/354.1 |
| 2,468,160 | 4/1949 | Benson | 248/354.1 |
| 2,790,657 | 4/1957 | Wilder | 248/354.1 |
| 3,313,505 | 4/1967 | Petrie | 254/98 |
| 3,588,023 | 6/1971 | Cohen | 248/410 |
| 3,908,318 | 9/1975 | Wallin | 248/354.1 |
| 4,221,363 | 9/1980 | Jasper | 254/98 |
| 4,928,916 | 5/1990 | Molloy | 248/354.1 |

FOREIGN PATENT DOCUMENTS

| | | | |
|---|---|---|---|
| 376063 | 7/1932 | United Kingdom | 248/354.1 |
| 530505 | 12/1940 | United Kingdom | 248/354.1 |
| 533991 | 2/1941 | United Kingdom | 248/354.1 |
| 1230843 | 5/1971 | United Kingdom | 248/410 |

OTHER PUBLICATIONS

Exxon Company U.S.A. Benicia Refinery Safety Additions To All Jackstands Used In The Exxon Refinery (Author Dale K. Cross, Mechanical Department Head, Feb. 4, 1992).

*Primary Examiner*—Robert C. Watson

[57] ABSTRACT

A high/low screw jack stand mechanism is presented having inner and outer telescoping tubes for coarse elevational adjustment and having an adjustment screw and nut assembly for fine elevational adjustment. For coarse adjustment a thrust washer, surrounding the inner work elevation tube, permits free upward movement of the elevating tube relative to the outer support tube and is automatically positioned in angular binding relation with the elevating tube by a thrust washer positioner which has supporting engagement with one side of the thrust washer to restrain downward movement of the elevating tube. A thrust washer restraint member extends upwardly from and in spaced relation with the thrust washer positioner to restrain the thrust washer from moving upwardly along with the elevation tube. To ensure against possible injury to workers when the thrust washer is manually moved to its release position, an inner stop is provided within the support tube to limit downward movement of the elevating tube to a position at which the adjustment nut and elevation tube support flange is sufficiently spaced from the thrust washer and its restraint that injury cannot occur.

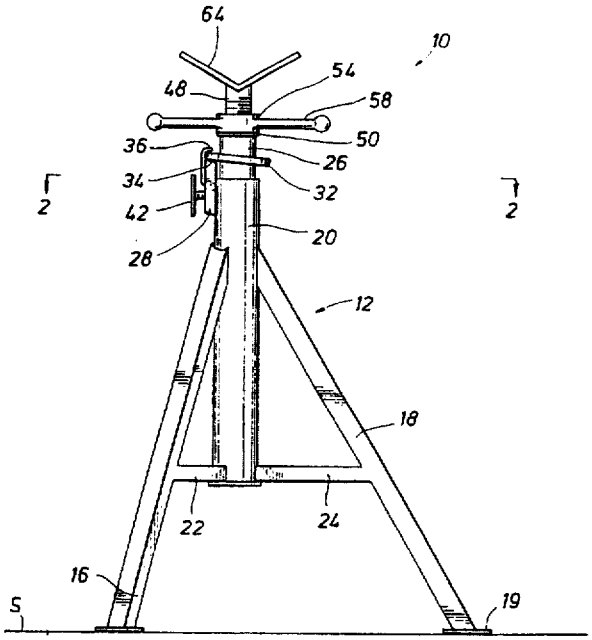

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4 and 12 are cancelled.

Claims 1, 3, 8, 10, 11 and 13 are determined to be patentable as amended.

Claims 2, 5, 6, 7, 9, 14, 15 and 16, dependent on an amended claim, are determined to be patentable.

Claim 17 was not reexamined.

1. A safety jack stand mechanism for supporting and positioning pipes and other objects such as during construction operations, comprising:

a. a base structure having a vertically oriented outer tubular member *said outer tubular member having open upper and lower ends*;

b. an inner tubular member defining upper and lower ends [being] *and having a lower portion thereof* disposed in telescoping relation within said outer tubular member, said inner tubular member [having] *defining* a thrust surface at the upper end thereof *said lower end of said inner tubular member defining a stop surface*;

c. [f] an adjustment screw being received in telescoping relation within said inner tubular member and defining external threads, said adjustment screw having a support member at the upper extremity thereof for support of objects;

d. an adjustment nut being threadedly received by said adjustment screw and being disposed in supported engagement with said thrust surface of said inner tubular member, said adjustment screw and said inner tubular member for vertical adjustment said inner tubular member and said support member;

e. a thrust washer positioner being fixed to said outer tubular member and having an upper end portion thereof projecting above said outer tubular member;

f. a thrust washer retainer element being fixed to said thrust washer positioner and having a portion thereof overlying and being disposed in spaced relation with said upper end portion of said thrust washer positioner;

g. [A] *a* thrust washer being located in loose fitting relation about said inner tubular member and, when disposed in predetermined angulated relation with said inner tubular member and, when disposed in predetermined angulated relation with said inner tubular member, establishing binding with said inner tubular member and restraining downward movement of said inner tubular member relative thereto, an outer peripheral portion of said thrust washer being located between said thrust washer positioner and said thrust washer retainer element and having positioned and supported engagement with said upper end portion of said thrust washer positioner; and

[means] *a circular tubular stop element being disposed in fixed relation within said lower end of said outer tubular member and defining an upwardly facing stop shoulder disposed for stopping engagement with said stop surface of said inner tubular member* for limiting downwardly telescoping movement of said inner tubular member relative to said outer tubular member to the extent that, at the maximum downward position of said inner tubular member, said thrust surface of said inner tubular member and said adjustment screw have sufficient vertical clearance relative to said thrust washer and thrust washer retainer that the hand or fingers of a worker cannot become pinched therebetween.

3. The safety jack stand mechanism of claim 1, wherein said [means for limiting downwardly telescoping movement of said inner tubular member] *circular tubular stop element* comprises:

a *circular tubular* stop member being disposed within said outer tubular member and defining [an] *said* upwardly facing stop shoulder, *said cylindrical tubular stop member* being located for stopping engagement with said lower end of said inner tubular member *and being connected to said outer tubular member*.

8. The safety jack stand mechanism of claim 1, wherein said thrust washer comprises:

a circular washer member having parallel upper and lower generally planar surfaces and having generally cylindrical inner and outer peripheral surfaces disposed in substantially normal relation with said upper and lower generally planar surfaces, said circular washer member further defining a generally conical upwardly facing [intern-al] *internal* surface intersecting said upper generally planar surface and said internal generally cylindrical surface.

10. A safety jack stand mechanism for supporting and positioning pipes and other objects such as during construction operations, comprising:

a. a base structure having a vertically oriented outer tubular member, *said outer tubular member having open upper and lower ends*;

b. an inner tubular member defining upper and lower *open* extremities and being disposed in telescoping relation within said outer tubular member and having a radially outwardly projecting peripheral thrust flange at the upper extremity thereof, *said lower extremity of said inner tubular member defining a circular stop surface*;

c. an elongate adjustment screw being received in telescoping relation within said inner tubular member and defining external threads, said adjustment screw having a support member at the upper extremity thereof of support of objects;

d. an adjustment nut being threadedly received by said adjustment screw and being supported by said outwardly projecting peripheral thrust flange, said adjustment nut being rotatable relative to said adjustment screw and said thrust flange for vertical adjustment of said adjustment screw and having opposed handles extending radially therefrom;

e. a thrust washer positioner being fixed to said outer tubular member and having an upper end portion thereof projecting above said outer tubular member and defining a thrust washer positioning portion;

f. a thrust washer retainer element being fixed to said thrust washer positioner and having a portion thereof overlying and being disposed in spaced relation with said washer positioning portion of said thrust washer positioner; and g. a thrust washer being located in loose fitting relation about said inner tubular member and, when disposed in predetermined angulated relation with said inner tubular member, establishing binding with said inner tubular member and restraining down movement of said inner tubular member relative thereto, a peripheral portion of said thrust washer being located between said thrust washer positioner and said thrust washer retainer element and having positioned and supported engagement with said upper end portion of said thrust washer positioner; and h. [means] *a generally cylindrical tubular stop element being disposed in fixed relation within said lower extremity of said outer tubular member and defining an upwardly facing circular stop shoulder located for stopping engagement by said stop surface* for limiting downwardly telescoping movement of said inner tubular member relative to said outer tubular member to the extent that, at the maximum downward position of said inner tubular member, said thrust flange of said inner tubular member and said adjustment screw have sufficient vertical clearance relative to said thrust washer and thrust washer retainer that the hand or fingers of a worker cannot become pinched therebetween.

11. The jack stand mechanism of claim 10, wherein said [means for limiting downwardly telescoping movement of said inner tubular member] *cylindrical tubular stop element* comprises:

a *cylindrical tubular* stop member *having open upper and lower ends and* being disposed within said outer tubular member and defining an upwardly facing stop shoulder being located for stopping engagement with said lower extremity of said inner tubular member.

13. The jack stand mechanism of claim 11, wherein:

said *generally cylindrical tubular* stop member [is] *being* fixed within said outer tubular member by welding.

* * * * *